US006272807B1

(12) United States Patent
Waldrop

(10) Patent No.: US 6,272,807 B1
(45) Date of Patent: Aug. 14, 2001

(54) RAIN DIRECTIONAL PANEL

(76) Inventor: Billy B. Waldrop, #28 Tiffany Trace, Anniston, AL (US) 36206

( * ) Notice: Subject to any disclaimer, the term of this patent is extended or adjusted under 35 U.S.C. 154(b) by 0 days.

(21) Appl. No.: 09/510,041

(22) Filed: Feb. 22, 2000

(51) Int. Cl.[7] ..... E04D 1/00

(52) U.S. Cl. ..... 52/518; 52/520; 52/543; 52/554

(58) Field of Search ..... 52/518, 519, 553, 52/554, 520, 521, 541, 543, 536

(56) References Cited

U.S. PATENT DOCUMENTS

| | | | | |
|---|---|---|---|---|
| Re. 33,566 | | 4/1991 | Heckelsberg . | |
| 2,005,219 | * | 6/1935 | Burriss | 52/519 |
| 2,108,350 | * | 2/1938 | Roth | 52/519 |
| 2,262,378 | * | 11/1941 | Zavodsky | 52/519 |
| 3,990,206 | * | 11/1976 | Reusser | 52/534 |
| 4,224,775 | | 9/1980 | Heckelsberg . | |
| 4,580,383 | | 4/1986 | Pittman et al. . | |
| 4,736,565 | | 4/1988 | Bisson . | |
| 5,187,911 | | 2/1993 | Cotter . | |
| 5,295,338 | * | 3/1994 | Guffey et al. | 52/478 |
| 5,507,126 | * | 4/1996 | Wu | 52/536 |
| 5,692,352 | | 12/1997 | Simpson . | |

* cited by examiner

*Primary Examiner*—Carl D. Friedman
*Assistant Examiner*—N. Slack
(74) *Attorney, Agent, or Firm*—Gene Scott-Patent Law & Venture Group

(57) ABSTRACT

A plurality of roof panels are used for covering a pitched roof. The roof panels are of a structural sheet metal, positioned and laid over the roof and provide a series of spaced apart longitudinal stiffening steps separated by at least one flat surface portion adapted for abutting the roof for enablement of attachment thereto. The top edge of each panel is convex and coved for use in covering a peak of the roof. A step is provided near the bottom edge of each panel for covering the covered top edge of a further one of the panels laid below it.

3 Claims, 1 Drawing Sheet

RAIN DIRECTIONAL PANEL

BACKGROUND OF THE INVENTION

1. Field of the Invention

This invention relates generally to roof coverings and more particularly to a roofing panel providing an integral ridge cap and a stiffening step designed to cover the ridge cap in an overlapping panel arrangement.

2. Description of Related Art

The following art defines the present state of this field:

Guffey et al., U.S. Pat. No. 5,295,338 describes a panel assembly for buildings and the like comprising, in combination with structure supporting the assembly, an array of overlapping elongated metal panels, each panel including a lower edge, an upper flange, and a web including at least one outwardly protruding longitudinally extending stiffening rib. The stiffening rib adjacent the upper flange has an elongated longitudinally extending groove and an extended bearing portion for contacting the structure when the panel is fastened thereto. These ribs provide structural support without purlins, sheathing, or the like. A plurality of fasteners for attaching the panel assembly to the structure pierce the extended bearing portion hold the bearing portion in contact with the structure so that when panels are affixed to the structure with the lower edge of one panel overlapping the upper flange of another panel, the groove forms a space between overlapping panels to prevent water from flowing around the stiffening rib adjacent the upper flange.

Pittman et al., U.S. Pat. No. 4,580,383 describes a building panel for exterior and interior wall and roof surfaces comprises an elongated body formed of relatively thin, molded hardboard having upper and lower edges, opposite ends, and outer face adapted for exposure to the weather and a back face generally following the contour thereof. The body includes a lower edge portion extending upwardly and outwardly of the lower edge of the panel and integralling joining and intermediate fascia portion spaced outwardly of the lower edge. An upper edge portion integrally joins an upper edge of the intermediate fascia portion and includes an upwardly and outwardly extending segment adapted to underlie a lower edge portion of a panel(s) laid up in a next higher course. The upper edge portion also includes a second segment extending between the first segment is generally parallel of the intermediate fascia panel portion and is adapted to underlie a portion of intermediate fascia portion of a panel(s) laid up in a next higher course. The upper edge portion is formed with a plurality of longitudinally spaced apart fastener receiving depressions extending inwardly of an outer face of the second segment of the upper edge portion. Longitudinally extending slot means are cut through the thin molded hardboard in the depressions between the inner and outer faces for receiving the shank of a nail or other fastener for securing the panels in place.

Bisson, U.S. Pat. No. 4,736,565 describes wall siding panels having vertical edge portions adapted to overlap and fasteners preventing the vertical joins so formed from bending or bulging outwardly. The panels have declinations and flat lengthwise, horizontal shoulders joining the declinations to resemble clapboard finishing. A female aperture is formed in each shoulder of one panel adjacent its vertical edge portion and a male projection is formed in each shoulder of the other panel adjacent its vertical edge portion. When a pair of two longitudinally-spaced, oppositely-directed projections are provided, which are selectively used so as to permit panel overlapping in any order edge portions are overlapped, each projection elements have identical profiles.

Heckelsberg, U.S. Pat. No. 33,566 describes a roof structure and its components comprises a series of metal panels having flanges that interlock when the panels are laid side by side and which are subsequently tightly seamed together to convert the individual panels into an integrated roof forming membrane. The roof structure may be insulated through the use of a blanket vapor barrier and insulation under the panels preferably along with thermal blocks located over the purlins. The roof structure includes unique flexible panel mounting clips that attach the panels to the purlins in such a way as to permit the panels to expand or contract in response to temperature and pressure changes, thereby minimizing roof stressing.

Heckelsberg, U.S. Pat. No. 4,224,775 describes the primary components of a roof structure which comprising a series of substantially identical metal panels having flanges that interlock when the panels are laid side by side and which are subsequently tightly seamed together to convert the individual panels into an integrated roof forming membrane. The interlock joints between adjacent panels are adapted for connection to flexible panel mounting clips that attach the panels to the purlins in such a way as to permit the panels to expand or contract in response to temperature and pressure changes, thereby minimizing roof stressing.

The prior art teaches the fabrication and use of building panels of various materials including metal sheets and constructions using such panels wherein the panels overlap and interlock at, or near their edges. However, the prior art does not teach that a roof panel having longitudinally ribs may be constructed and shaped for elimination of a ridge cap and for covering a convex coving portion with a step portion of an abutting panel laid overlapping and atop. The present invention fulfills these needs and provides further related advantages as described in the following summary.

SUMMARY OF THE INVENTION

The present invention teaches certain benefits in construction and use which give rise to the objectives described below.

A plurality of roof panels are used for covering a pitched roof. The roof panels are of a structural sheet metal, positioned and laid over the roof and provide a series of spaced apart longitudinal stiffening steps separated by at least one flat surface portion adapted for abutting the roof for enablement of attachment thereto. The top edge of each panel is convex and coved for use in covering a peak of the roof. A step is provided near the bottom edge of each panel for covering the coved top edge of a further one of the panels laid below it.

A primary objective of the present invention is to provide a shelter and roof panel covering having advantages not taught by the prior art.

Another objective is to provide such a covering with longitudinal stiffening steps.

A further objective is to provide such a covering enabled for the elimination of the customary ridge cap.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE INVENTION

Figures 1, 2, 3:
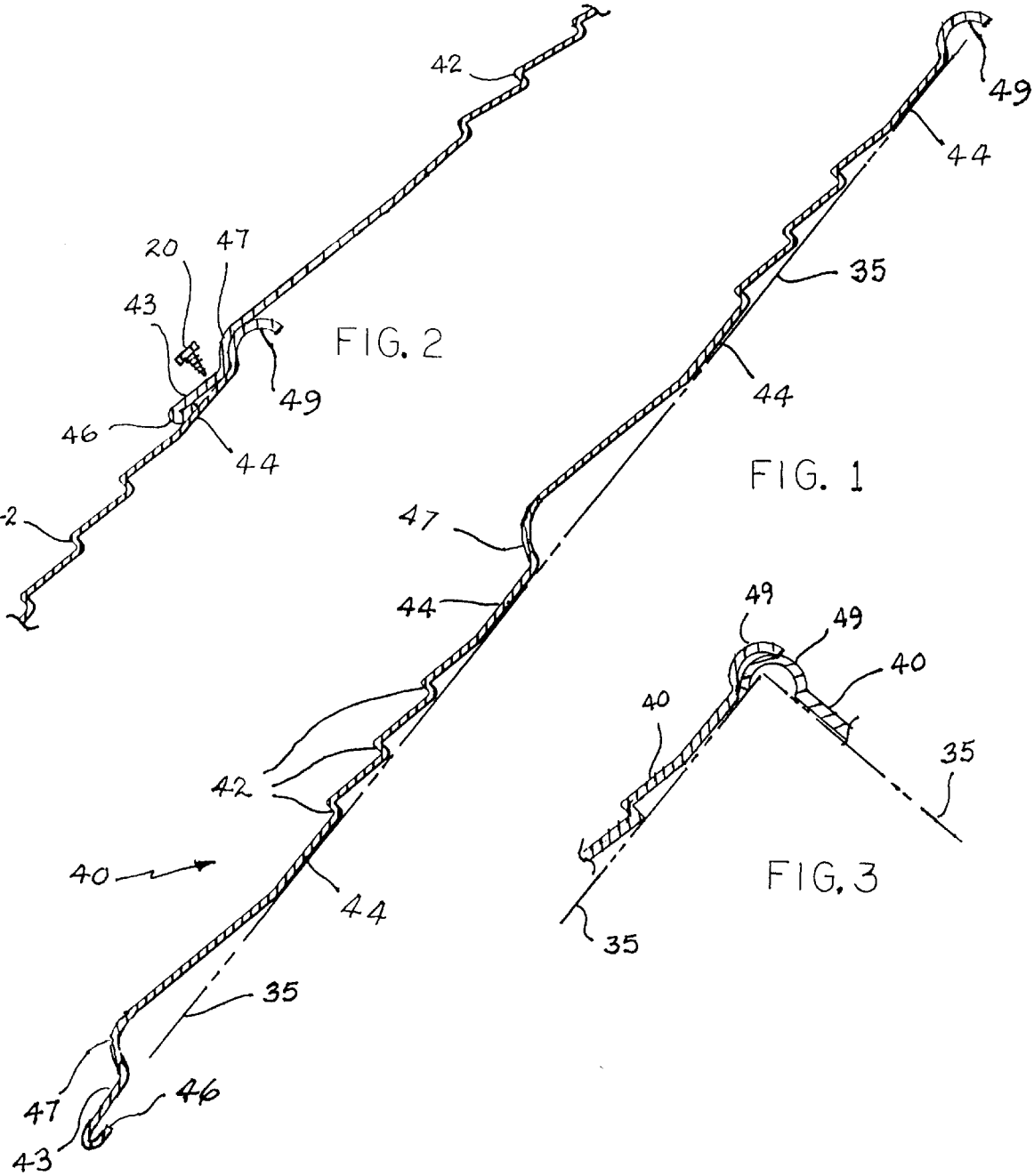
FIG. 1 is a sectional view of a roof panel of the present invention.
FIG. 2 is a partial sectional view of two of the roof panel of FIG. 1 showing the means for overlapping the panels.
FIG. 3 is a partial sectional view of two of the roof panels of FIG. 1 laid onto opposing sides of a peaked roof and showing the manner of overlapping convex shaped top edges of the panels to replace a ridge cap.

The above described drawing figures illustrate the invention, a plurality of roof panels 40 of a structural sheet metal, preferably of 26 or 29 gauge coated or galvanized steel, but other structural materials/finishes may alternately be used. These panels 40 are positioned and laid over a roof so as to generally lay at the selected pitch angle thereon. The roof panels 40 provide at least one series of spaced apart longitudinal stiffening steps 42 separated by at least one flat surface portion 44 adapted for abutting the roof 35 for enablement of attachment thereto using convention fastening means such as nails or screws.

Each of the roof panels 40 comprises a top edge portion 49 configured as a convex-shaped coving and a bottom edge 46 terminally finishing a terminal flat portion 43 of the roof panels 40, the bottom edge 46 being bent back upon itself for presenting a smooth edge surface for safety in handling the panels during installation. This feature also eliminates the need for "J" trim as is commonly used with such construction. The terminal flat portion 43 is interrupted by, and contiguous with, an upwardly extending large step portion 47, the large step portion being of such shape and size as to encompass and closely fit over the arc-shaped coving of the top edge portion 49 of a further roof panel laid therebelow as clearly shown in FIG. 2.

The roof panels 40 each further provide the recurring flat section 44 configured for laying flat against the pitched roof 35 so as to be easily joined thereto with fasteners 20 as shown in FIG. 2. The roof panels 40 each further provide at least one series of laterally spaced apart, stiffening steps 42 directed in parallel alignment with the top 49 and bottom edges 46 of the panels 40.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A pitched roof covering comprising a plurality of rectangular roof panels of structural sheet material adapted for forming a pitched roof having a pitch angle; wherein each of the roof panels comprises a top edge portion configured as a smooth arc forming an approximate half-circle, contiguous with a top flat section, coplanar with the pitch angle, and a bottom edge portion comprising a bottom flat section coplanar with the pitch angle, and contiguous with an upwardly extending arced step portion, the step portion of such shape and size as to lay in significant surface-to-surface contact, with the smooth arc of the top edge portion of a further roof panel laid therebelow, the top flat section and the bottom flat section laying in mutual contact for being jointly fastened to a building structure.

2. The covering of claim 1 wherein the roof panels each further provide a recurring flat section configured for laying flat against the pitched roof so as to be easily joined thereto.

3. The covering of claim 2 wherein the roof panels each further provide at least one series of laterally spaced apart, stiffening steps directed in parallel alignment with the top and bottom edges of the panels.

* * * * *